US005224704A

United States Patent [19]

Snell

[11] Patent Number: 5,224,704

[45] Date of Patent: Jul. 6, 1993

[54] GAME BALL

[76] Inventor: William L. Snell, 632 Sheldon St., El Segundo, Calif. 90245

[21] Appl. No.: 881,652

[22] Filed: May 12, 1992

[51] Int. Cl.[5] ..... A63B 41/00

[52] U.S. Cl. ..... 273/65 EC; 273/65 EF; 273/DIG. 20; 482/20

[58] Field of Search ..... 273/65 EG, 65 EC, 65 E, 273/65 ED, 65 EE, 65 EF, 58 B, 58 BA, DIG.20; 482/20

[56] References Cited

U.S. PATENT DOCUMENTS

| | | | |
|---|---|---|---|
| 1,597,308 | 8/1926 | Brandt | 273/65 EC |
| 3,884,466 | 5/1975 | MacDonald et al. | 273/65 EC |
| 4,998,728 | 3/1991 | Traub | 273/65 EC X |
| 5,098,097 | 3/1992 | Kennedy et al. | 273/65 EC |
| 5,123,645 | 6/1992 | MacDonald et al. | 273/65 EC |

*Primary Examiner*—George J. Marlo
*Attorney, Agent, or Firm*—Roger A. Marrs

[57] ABSTRACT

A missle such as a ball incorporating a weighted mass having selected optimum for a given mass, velocity, spin and size while simultaneously making I as large as possible. The optimum selected weighted mass creates the desired in-flight path of the missile which experiences less perturbation so that missile precession and nutation is suppressed. In one form, the missile includes an elliptical spheroid such as a football having the selected weighted mass provided in an enclosure or covering with a hollow shell having a cavity containing an air volume. A cushion material such as foam is carried on opposite ends of the ball separating the shell from the covering. A band is disposed about the enclosure and shell midsection coaxially disposed with respect to the central longitudinal axis of the elliptical spheroid. Arcuate projections or arms are carried on the band in pairs cantilevered outwardly from opposite sides of the band adjacent to the shell Each pair is substantially separated from the other pair by 90 degrees and includes weighted ends.

1 Claim, 2 Drawing Sheets

GAME BALL

BACKGROUND OF THE INVENTION

1. Field of the Invention

The present invention relates to the field of flying missiles and more particularly to a novel means for stabilizing the flight of an elliptical object such as a ball by providing a selective, arrangement of weighted mass about the midsection of the object.

2. Brief Description of the Prior Art

Conventional elliptical, inflated spheroids such as footballs are considered unstable in flight from their point of launch to a remote target point. In order to stabilize the missile's flight as much as possible, a high spin speed is induced into the missile so as to reduce small pointing errors or induced nutation along its path of travel. Considerable skill is required of a person who manually induces flight to the missile and an improperly launched ball exhibits unstable behavior which typically worsens from the beginning of flight to the end of the ball's travel. Types of unstable flight behavior which is unacceptable are due to insufficient spin speed or errors in initial conditions which result in nutation or precession since spin axis fails to track or maintain course on the tangent to the flight path. In other words, the missile fails to stabilize at $\theta=0$.

Precession and nutation characteristics of the missile dominate its dynamics and spin axis will not converge at $\theta=0$ even though average position does track flight path.

Furthermore, external torque is induced into the missile from impinging wind or ram air coupled with initial transverse rates such as encountered with an improper launch. This will usually tend to make the instability of travel increase. If precession and nutation are created such that resultant viscous damping forces from air and control of precession and nutation angle is optimized, the missile tends to stay on tangent flight path and therefore experiences perturbation and follows in a stabilized path where precession and nutation are suppressed.

Therefore, a long-standing need has existed to provide a novel stabilizing means for an elliptical spheroid, inflated or not, which overcomes the inherent problems of precession and nutation encountered with conventional elliptical spheroids by optimizing dynamic properties and coupling to viscous air drag to thus suppress transverse rates such as precession and nutation. Such a missile may incorporate the critical placement of weighted masses within the enclosure of the missile about its midsection so that the missile will travel along its transverse path maintaining utmost stability about its longitudinal axis.

SUMMARY OF THE INVENTION

Accordingly, the above problems and difficulties are obviated by the present invention which provides a novel missile having improved stabilization characteristics wherein the missile may take the form of an elliptical, inflated spheroid having an enclosure or covering in which weighted masses are selectively located about the midsection of an inner shell. Broadly, the missile includes selected weighted material or mass critically located and secured to the exterior of the shell to enclose a cavity containing a pressurized air volume. The weighted mass further includes an endless band or ring coaxially disposed with respect to the central longitudinal axis of the missile. Arcuate projections or arms are carried on the ring or band in pairs which are outwardly cantilevered from opposite sides of the band adjacent to the supporting shell wherein each pair of arms is substantially separated from the other pair of arms by 90 degrees with respect to the central longitudinal axis. Additional weighted mass may be placed on the ends of the respective arms to augment the overall weighted mass of the spheroid or missile. A covering about the weighted shell completes the construction with high strength-to-weight material such as foam occupies voids between the shell and the covering.

Therefore, it is among the primary objects of the present invention to provide a novel missile construction providing improved and maximum stability for an elliptical spheroid that is launched and travels along a curved flight path or trajectory.

Another object of the present invention is to provide a novel means for constructing a missile that has improved stabilization characteristics so as to minimize or eliminate adverse effects of progression and nutation of the missile as it travels in flight along a curved path.

Still another object of the present invention is to provide a novel missile having weighted mass distributed in critical locations so as to increase the stability of the missile during flight and wherein the weighted mass is of selected optimum values of $I_3/I_1$ for a given mass, velocity, spin and size while simultaneously making I as large as possible.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
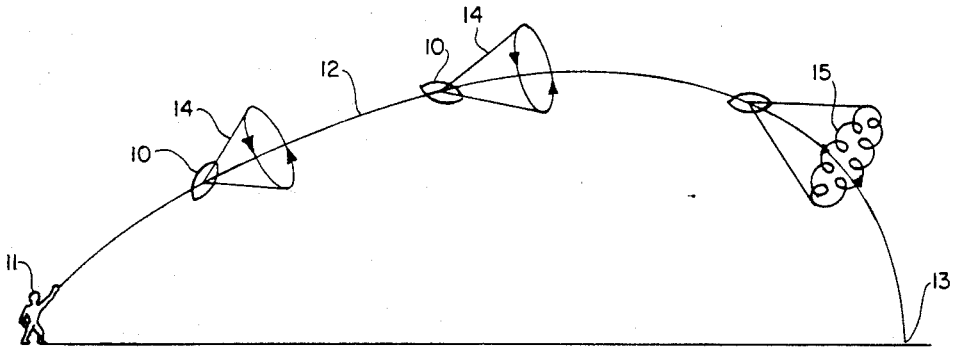
FIG. 1 is a diagrammatic view showing a conventional elliptical spheroid serving as a missile travelling along a flight path in accordance with prior and current practice.

Referring to FIG. 1, a conventional ellipsoidal ball such as a football is indicated by numeral 10 and is illustrated as having been tossed by a player 11 in a game such as a football game. The conventional ball 10 is following a tangent path of a curved nature and the flight path is indicated by numeral 12 commencing at the player 11 and terminating at a target point 13. It can be seen that as the forward speed of the ball diminishes and due to the effects of gravity, the flight path attenuates steeply as the ball approaches the target point 13. It can also be seen that even with player skill, the ball 10 experiences a wobble or nutation since the longitudinal axis of the ball is not parallel with the path of flight 12. A spinning cone 14 illustrates the pattern of wobble and this pattern is accelerated to experience considerable disturbance along the path of flight and the disturbance creates drag due to precession and nutation which becomes considerably excessive near the target point and such turbulence is indicated by numeral 15. Also the external torque developed in the ball from the wind is coupled with the initial transverse rates due to an unskilled throw of the ball and this will usually tend to make instability increase along the flight path. Therefore, if precession and nutation are controlled such that resultant viscous damping from impact or ram air and control of precession and nutation angle is optimized, the ball will tend to stay on tangent various flight paths of FIG. 2. Not only will accuracy of throw be improved, but distance of throw can be increased.

Figure 2:
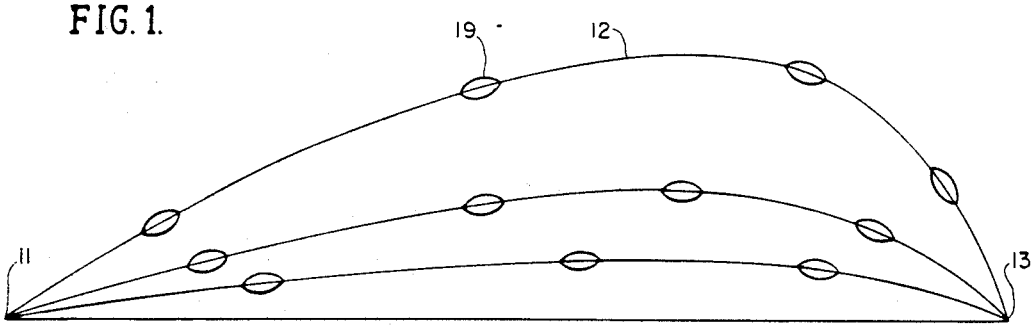
FIG. 2 is a view similar to the view of FIG. 1 illustrating the inventive missile in travel and which incorporates the stabilization principles set forth in the present invention.

Referring now to FIG. 2, the ball 19 incorporates the present invention and precession and nutation are suppressed regardless of the flight path taken from the commencement of flight at numeral 11 to the target point 13; the flight path extends along the central longitudinal axis of the ball 19. In accordance with the principles of the present invention, the stabilized flight as shown by the ball in FIG. 2 is achieved by selecting optimum values of $I_3/I_1$ for a given mass, velocity, spin and size, while simultaneously making I as large a value as possible. This optimum and unique feature having $I_3/I_1$ creates the desired effect by optimizing dynamic properties and coupling to viscous air drag. Thus, transverse rates as precession and nutation are suppressed.

Figure 3:
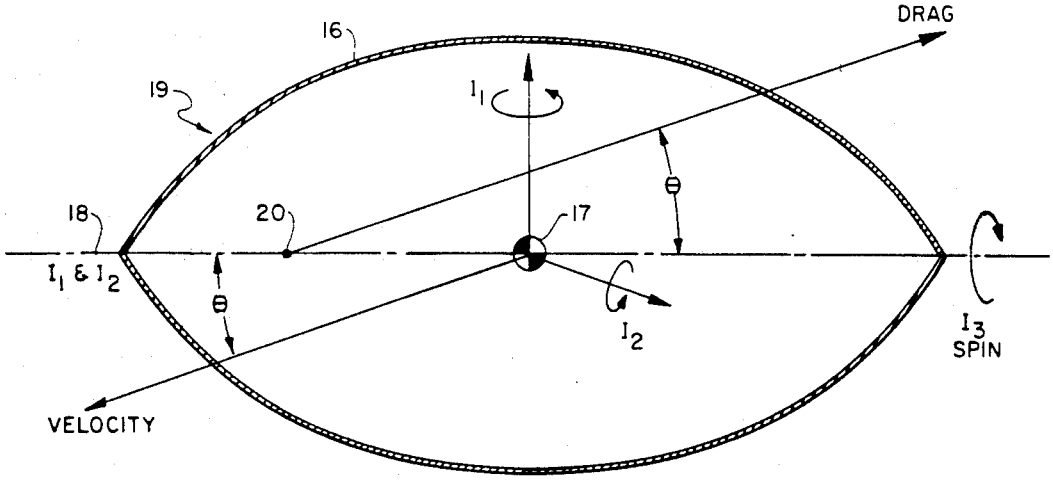
FIG. 3 is a diagrammatic view of an elliptical spheroid illustrating system dynamics which permit tangential alignment of spin axis to flight path and with minimal residual transverse rates such as nutation and precession.

Referring now in detail to FIGS. 2 and 3, the ball 10 incorporating the structure of the present invention is illustrated as having a covering 16 for housing the respective masses wherein the center of mass is indicated by numeral 17 and the central longitudinal axis is indicated by numeral 18. The center of pressure is indicated by numeral 20 which is also the external torque. The covering 16 may be a nominal thin shell or may be a solid body with the mass integrally disposed therein. The external torque is due to the angle of relative wind. The present invention achieves stability by selecting optimum value of $I_3/I_1$ for a given mass, velocity and spin and size while simultaneously maintaining I as large as possible. Implementation is achieved for a given mass ball; there is optimum $I_3/I_1$ where $I_1$ is as large as possible. Making $I_1$ large while holding unique $I_3/I_1$ can be done only in special ways given the geometrical constraints of the football shape. For a relatively lightweight ball 10, correct $I_3/I_1$ conditions ($I_1$ maximum) cannot be created with homogeneous shell or solid body. For every size and weight ball, there is an optimum stability condition that is, $I_3/I_1$ equals unique value as determined by theory and where $I_1$ is maximized such as by constraints of geometry. Any ball can be made to employ the stabilization principles of the present invention. The inventive concept is to create stability at easy and convenient to throw weights and with near to normal sizes.

Figure 4:
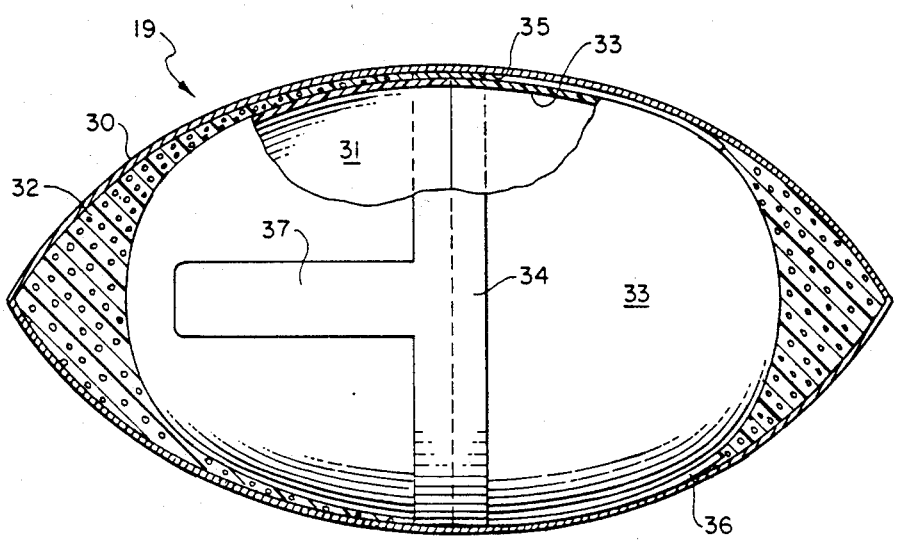
FIG. 4 is a transverse cross-sectional view of an elliptical spheroid as a missile incorporating the disposition of weighted mass in order to achieve stabilization in flight in accordance with the present invention.
Figure 5:
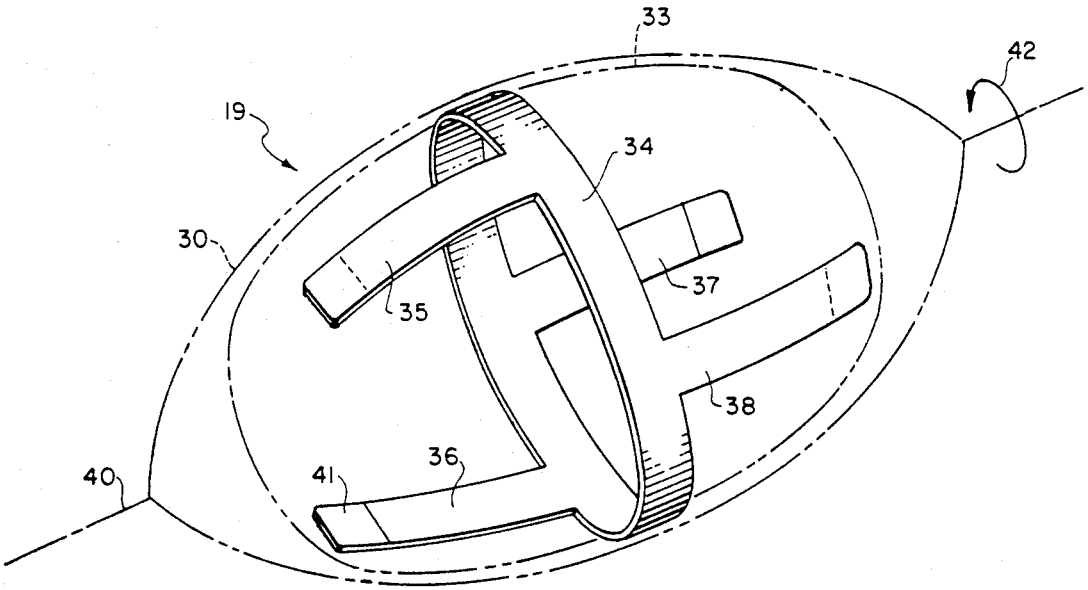
FIG. 5 is a perspective view showing the inner ring or band and outwardly projected arms included in the weighted mass arrangement employed in the spheroid of FIG. 4.

Referring now in detail to FIGS. 4 and 5. The missile or ball represented includes a shell or covering 30 which is a tough skin or rigidized foam. A central cavity 31 is employed for containing pressurized air so that the ball is inflated and the cavity is defined by foam material, as indicated by numeral 32, which is disposed between the covering 30 and a rigidized plastic shell 33.

It is particularly to be noted that the shell 33 may be composed of a thin membrane of plastic which has an oval or elliptical shape and is hollow so as to define an inner cavity in which pressurized or unpressurized air may be contained. Areas surrounding the exterior of the shell 33 and beneath the cover 30 are occupied by the high-to-strength ratio foam material 32 so as to give the cover 30 the desired shape such as a football.

The weighted mass carried by the ball 19 includes a circular band 34 located on the outside of the shell 33 midway between its opposite ends and coaxial with respect to the central longitudinal axis of the ball itself. The mass further includes, more clearly shown in FIG. 5, two pairs of outwardly extending arms represented by numerals 35 and 36 associated as one pair and numerals 37 and 38 associated with the other pair. Each pair is cantilevered outwardly from the ring 34 and located approximately 180 degrees from one another. Therefore, it can be said that arms 35 and 36 may be at the top and bottom of the ball while arms 37 and 38 extend outwardly from the sides of the ball. Also, it can be seen in FIG. 5 that the pairs of arms are situated substantially 90 degrees from one another about the central longitudinal axis of the ball. The central longitudinal axis is identified by numeral 40. Furthermore, the weighted mass can also include weighted elements 41 carried on the end of each arm, such as arm 36. When the ball or missile 19 is spun, such as indicated by the arrow 42, the weighted ends 41 on the respective arms will spin substantially coaxial with respect to the central axis 40.

Therefore, in view of the foregoing, it can be seen that the ball of the present invention will follow in a stabilized manner a trajectory from a launching point to a target point so that the ball is stabilized and free from wobble or other distortion normally encountered with conventional missiles. The weighted mass is evenly distributed about the midsection of the ball. The inner shell and the foam reinforcement between the shell and the inner surface of the covering provide a tough and rigid missile which can readily be handled for throwing, catching or otherwise launching the ball.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A game ball adapted to be thrown in a spiral comprising:

a thin walled shell of oblong configuration having opposite ends separated by a midsection and defining a cavity in which pressurized air may be contained;

a weighted mass disposed about said midsection of said shell contributing to the stability of the ball in flight as it spins about a central longitudinal axis;

a cover enclosing said shell and said weighted mass and in spaced-apart relationship from said shell to define voids therebetween;

filler material carried about said shell occupying said voids between said cover and said shell;

said weighted mass including a ring carried about said shell at its longitudinal midsection and a pair of outwardly projecting reinforcement arms located on opposite sides of said ring in a cantilevered manner;

said arms including a weight element at the free end of each cantilevered arm; and the arms of each of said pairs of arms, respectively, being disposed 180 degrees apart, in first and second plane which are 90 degrees apart.

* * * * *